US006687667B1

(12) United States Patent
Gournay et al.

(10) Patent No.: US 6,687,667 B1
(45) Date of Patent: Feb. 3, 2004

(54) METHOD FOR QUANTIZING SPEECH CODER PARAMETERS

(75) Inventors: Philippe Gournay, Asnieres (FR); Frédéric Chartier, Paris (FR)

(73) Assignee: Thomson-CSF, Paris (FR)

( * ) Notice: Subject to any disclaimer, the term of this patent is extended or adjusted under 35 U.S.C. 154(b) by 0 days.

(21) Appl. No.: 09/806,993

(22) PCT Filed: Oct. 1, 1999

(86) PCT No.: PCT/FR99/02348

§ 371 (c)(1),
(2), (4) Date: Apr. 6, 2001

(87) PCT Pub. No.: WO00/21077

PCT Pub. Date: Apr. 13, 2000

(30) Foreign Application Priority Data

Oct. 6, 1998 (FR) ..... 98 12500

(51) Int. Cl.[7] ..... G10L 19/02
(52) U.S. Cl. ..... 704/222; 704/219; 704/220
(58) Field of Search ..... 704/200, 201, 704/219, 220, 222, 221

(56) References Cited

U.S. PATENT DOCUMENTS 5,255,339 A * 10/1993 Fette et al. ..... 704/200
6,094,629 A * 7/2000 Grabb et al. ..... 704/219
6,408,273 B1 * 6/2002 Qualiaro et al. ..... 704/271

OTHER PUBLICATIONS

U.S. patent application Ser. No. 09/978,680, filed Oct. 18, 2001 pending.

* cited by examiner

*Primary Examiner*—Susan McFadden
(74) *Attorney, Agent, or Firm*—Oblon, Spivak, McClelland, Maier & Neustadt, P.C.

(57) ABSTRACT

A method for encoding speech at a low bit rate. The method assembles parameters on N consecutive frames to form a super-frame. A vector quantization of transition frequencies of a voicing during each super-frame is made. Only the most frequent configurations are transmitted without deterioration and the least frequent configurations are replaced by the configuration that is the nearest in terms of absolute error among most frequent configurations. The pitch is encoded in carrying out a scalar quantization of only one value of the pitch for each super-frame. The energy is encoded in selecting only a reduced number of values in assembling these values in sub-packets quantized by vector quantization. The spectral envelope parameters are encoded by vector quantization in selecting only a determined number of filters. The untransmitted energy values are recovered in the synthesis part by interpolation or extrapolation from transmitted values. Such a method may find particular application in vocoders.

12 Claims, 5 Drawing Sheets

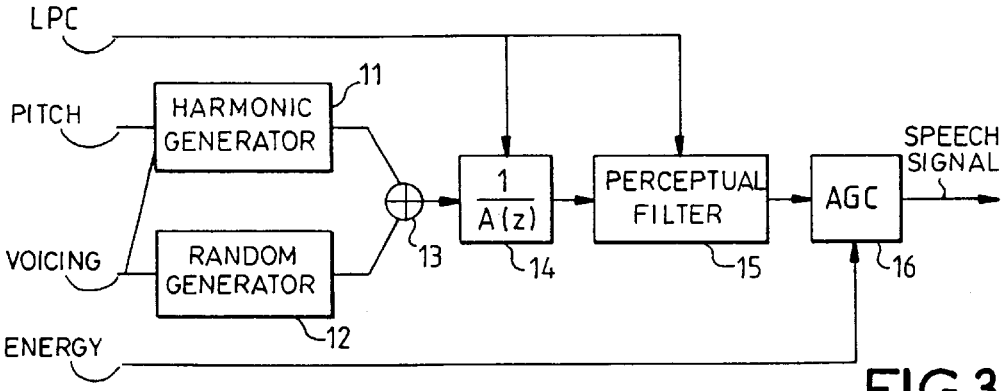

FIG.3

| VOICING CONFIGURATION | NUMBER OF SUPER-FRAMES |
|---|---|
| TOTALLY UNVOICED (INCLUDING THE SILENCES) | 55.585 |
| TOTALLY VOICED | 34.586 |
| PARTIALLY UNVOICED (30 MOST FREQUENT) | 30.273 |
| PARTIALLY UNVOICED (32 LEAST FREQUENT) | 2.714 |
| TOTAL SUPER-FRAMES : | 123.158 |

FIG.5

| NAME OF THE PATTERN | VECTOR 1 | VECTOR 2 | INTERPOLATED VALUES |
|---|---|---|---|
| STABLE | 1,3,5 | 7,9,11 | 0,2,4,6,8,10 |
| FRAME 1 | 0,1,2 | 3,7,11 | 4,5,6,8,9,10 |
| FRAME 2 | 1,4,5 | 6,7,11 | 0,2,3,8,9,10 |
| FRAME 3 | 2,5,8 | 9,10,11 | 0,1,3,4,6,7 |

23

FIG.7

| NAME OF THE PATTERN | QUANTIZED LPC | INTERPOLATED LPC | EXTRAPOLATED LPC |
|---|---|---|---|
| STABLE | 1,3,5 | 0,2,4 | — |
| FRAME 1 | 0,1,4 | 2,3 | 5 |
| FRAME 2 | 2,3,5 | 0,1,4 | — |
| FRAME 3 | 1,4,5 | 0,2,3 | — |

24

FIG.8

| | | |
|---|---|---|
| 0 | 750 | 3625 |
| 0 | 3625 | 3625 |
| 0 | 2000 | 3625 |
| 750 | 3625 | 3625 |
| 0 | 0 | 3625 |
| 750 | 2000 | 3625 |
| 750 | 750 | 3625 |
| 2000 | 2000 | 3625 |
| 0 | 0 | 2000 |
| 750 | 750 | 750 |
| 750 | 750 | 0 |
| 2000 | 2000 | 750 |
| 0 | 0 | 750 |
| 0 | 0 | 0 |
| 750 | 0 | 0 |
| 2000 | 750 | 0 |
| | | |
| 2000 | 2000 | 2000 |
| 3625 | 3625 | 2000 |
| 2000 | 3625 | 3625 |
| 3625 | 3625 | 3625 |
| 2000 | 750 | 750 |
| 3625 | 2000 | 750 |
| 3625 | 2000 | 2000 |
| | | |
| 3625 | 2000 | 3625 |
| 2000 | 2000 | 0 |
| 3625 | 2000 | 0 |
| 3625 | 3625 | 0 |
| 3625 | 3625 | 750 |
| 2000 | 0 | 0 |
| 3625 | 0 | 0 |
| 3625 | 750 | 0 |
| 3625 | 750 | 750 |

22

FIG. 6

| PARAMETER | NUMBER OF BITS |
|---|---|
| LSFs | 54 |
| DECIMATION PATTERN (LSFs) | 2 |
| ENERGY | 2*6 |
| DECIMATION PATTERN (ENERGY) | 2 |
| PITCH | 6 |
| VOICING | 5 |
| TOTAL BITS / 67.5 ms | 81 |

FIG. 9

METHOD FOR QUANTIZING SPEECH CODER PARAMETERS

The present invention relates to a speech-encoding method. It can be applied especially to the making of vocoders working at very low bit rates, in the range of about 1,200 bits per second and implemented for example in satellite communications. Internet telephony static responders, voice pagers etc.

The purpose of these vocoders is to rebuild a signal that is as close as possible, in the sense of perception by the human ear, to the original speech signal, in using the lowest possible binary rate.

To achieve this goal, vocoders use a completely parameterized model of the speech signal. The parameters used pertain to voicing which describes the periodic character of the voiced sounds or the randomness of unvoiced sounds, the fundamental frequency of the voiced sounds, also known as "pitch", the temporal evolution of the energy as well as the spectral envelope of the signal to excite and parameterize the synthesis filters. The filtering is generally performed by a technique of linear predictive digital filtering.

These various parameters are estimated periodically on the speech signal, from one to several times per 10-ms to 30-ms frame, depending on the parameters and the coders. They are prepared in an analysis device and are Generally transmitted remotely to a synthesis device.

The field of low-bit-rate speech-encoding has long been dominated by a 2400 bits/s encoder known as the LPC 10. A description of this encoder, as well as of an alternative working at a lower bit rate can be found in the following articles:

"Parameters and coding characteristics that must be common to assure interoperability of 2400 bps linear predictive encoded speech", NATO Standard STANAG-4198-Ed 1, Feb. 13 1984 and in the article by B. Mouy, D de la Noue et G. Goudezeune, "NATO STANAG 4479: A Standard for an 800 bps Vocoder and Channel Coding in HF-ECCM system", in IEEE International Conference on Acoustics, Speech, and Signal Processing, Detroit, May 1955, pp. 480–483.

While the speech reproduced by this vocoder is perfectly intelligible, it is of rather poor quality, so that its use is limited to quite specific applications mainly professional and military applications. In recent years the field of low-bit-rate speech encoding has seen very many innovations through the introduction of new models known respectively under the abbreviations. MBE, PWI and MELP.

A description of the MBE model can be found in the article by D. W. Griffin and J. S. Lim. "Multiband Vocoders Excitation" in IEEE Transactions On Acoustics, Speech, and Signal Processing, vol. 36, No. 8, pp. 1223–1235, 1988.

A description of the PWI model can be found in the article by W. B. Kleijn and J Haogen, "Waveform Interpolation for Coding and Synthesis", in W. B. Kleijn and K. K. Paliwal ed. Speech Coding and Synthesis, Elsevier 1995.

Finally, a description of the MELP model can be found in the article by L. M. Supplee, R. P. Cohn, J. S. Collura, and A. V. McCree, "MELP: The New Federal Standard At 2400 bits/s", in IEEE International Conference on Acoustics, Speech, and Signal Processing, Munich, April 1997, pp. 1591–1594.

The quality of the speech restored by these 2400 bits/s models has become acceptable for a large number of civilian and commercial applications. However, for bit rates below 2400 bits/s (typically 1200 bits/s or less) the restored speech is of inadequate quality and, to mitigate this drawback, other techniques have been used. A first technique is that of the segmental vocoder, two variants of which are described by. B. Mouy, P. de la Noue and G. Goudezeune already referred to, and by Y. Shoham, "Very Low Complexity Interpolative Speech Coding At 1.2 To 2.4 K bps", in IEEE International Conference on Acoustics, Speech, and Signal Processing, Munich. April 1997, pp 1599–1602.

To date, however, no segmental vocoder has been deemed to be of a quality sufficient for civilian and commercial applications.

A second technique is that implemented in phonetic vocoders, which combine principles of recognition and synthesis. The activity in this field is rather at the fundamental research stage. The bit rates involved are generally far lower than 1,200 bits/s (typically 50 to 200 bits/s) but the quality obtained is rather poor and there is often no recognition of the speaker. A description of these types of vocoders can be found in the article by J Cernocky, G Baudoin, G Chollet,: "Segmental Vocoder-Going Beyond The Phonetic Approach" in International IEE Conference on Acoustics, Speech, and Signal Processing, Seattle, May 12–15 1998, pp. 605–698.

The goal of the invention is to mitigate the above-mentioned drawbacks.

To this end, an object of the invention is a method of encoding and decoding speech for voice communications using a vocoder with a very low bit rate comprising an analysis part for the encoding and transmission of the parameters of the speech signal and a synthesis part for the reception and decoding of the parameters transmitted, and the rebuilding of the speech signal through the use of linear predictive synthesis filters of the type consisting in analyzing the parameters, describing the pitch, the voicing transition frequency, the energy, and the spectral envelope of the speech signal, by subdividing the speech signal into successive frames of given length characterized in that it consists in assembling the parameters on N consecutive frames to form a super-frame, making a vector quantization of the transition frequencies of the voicing during each super-frame, transmitting without deterioration only the most frequent configurations and replacing the least frequent configurations by the configuration that is the nearest in terms of absolute error among the most frequent configurations, encoding the pitch in carrying out a scalar quantization of only one value for each super-frame, encoding the energy in selecting only a reduced number of values in assembling these values in sub-packets quantized by vector quantization, the non-transmitted energy values being recovered in the synthesis part by interpolation or extrapolation from transmitted values, encoding, by vector quantization, the spectral envelope parameters for the encoding of the linear prediction synthesis filters by selecting only a specified number of filters, the untransmitted parameters being rebuilt by interpolation or extrapolation from the parameters of the transmitted filters.

Other characteristics and advantages of the invention shall appear from the following description made with reference to the appended drawings, of which:

FIG. 3 is a functional diagram of the synthesis part of an HSX type vocoder used to implement the invention.

FIG. 5 is a table showing the distribution of the configurations of the voicing transition frequencies for three consecutive frames.

FIG. 6 is a table of vector quantization of the voicing transition frequencies that can be used to implement the invention.

FIG. 7 is a list in table form of selection and interpolation diagrams implemented in the invention for the coding of the energy of the speech signal.

FIG. 8 is a list in table form of selection and interpolation/extrapolation diagrams for the encoding of linear predictive LPC filters.

FIG. 9 is a bit allocation table pertaining to the bits necessary for the encoding of 1200 bit/s HSX type vocoder according to the invention.

The method according to the invention implements a type of vocoder known by the HSX or "Harmonic Stochastic Excitation" vocoder used as the basis for making a high-quality 1200-bits/s vocoder.

A description of this type of vocoder can be found in C. Laflamme, R. Salami, R. Matmti and J. P. Adoul, "Harmonic Stochastic Excitation (HSX) Speech Coding Below 4 k.bits/s" in IEEE International Conference on Acoustics, and Signal Processing, Atlanta, May 1996, pp.204–207.

The method according to the invention relates to the encoding of the parameters that enable the most efficient reproduction, with a minimum bit rate, of the entire complexity of the speech signal.

Figure 1:
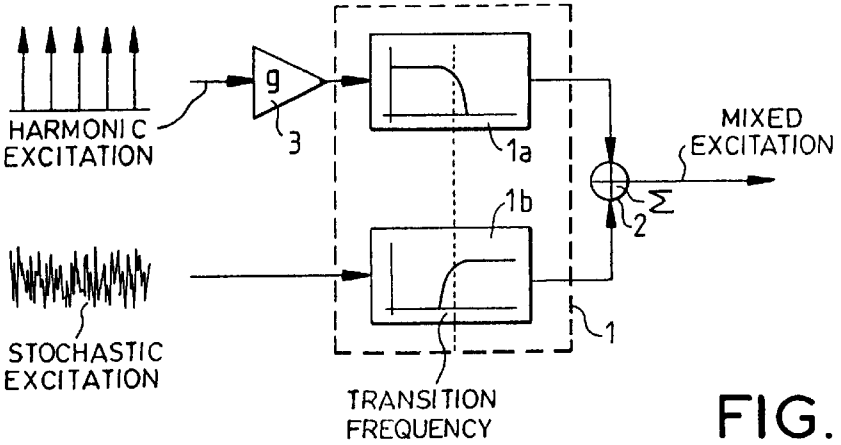
FIG. 1 shows a mixed excitation model of an HSX type vocoder used for the implementation of the invention.

As shown schematically in FIG. 1, an HSX vocoder is a linear predictive vocoder that uses a simple mixed excitation model in its synthesis part. In this model, a periodic pulse train gives excitation at the low frequencies and a noise level gives excitation at the high frequencies of an LPC synthesis filter. FIG. 1 describes the principle of generation of the mixed excitation which comprises two filtering channels. The first channel $\mathbf{1}_1$, excited by a periodic pulse train, performs a low-pass filtering operation and the second channel $\mathbf{1}_2$, excited by a stochastic noise signal, performs a high-pass filtering operation. The cut-off or transition frequency $f_c$ of the filters of the two channels is the same and has a position that varies in time. The filters of the two channels are complementary. A summator 2 adds up the signals given by the two channels. An gain g amplifier 3 adjusts the gain of the first filtering channel so that the excitation signal obtained at output of the summator 2 is a flat spectrum signal.

Figure 2:
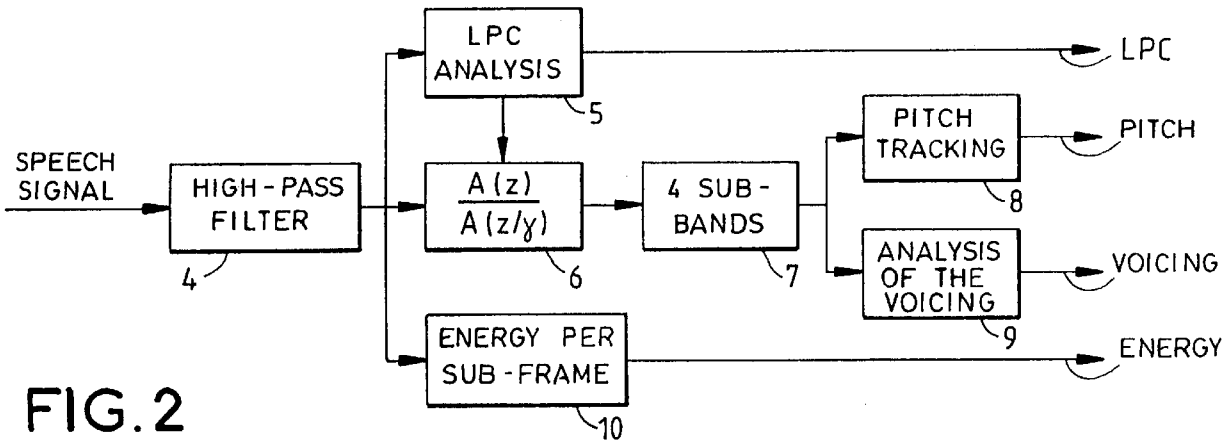
FIG. 2 is a functional diagram of the "analysis" part of an HSX type vocoder used to implement the invention.

A functional diagram of the analysis part of the vocoder is shown in FIG. 2. To perform this analysis, the speech signal is first of all filtered by a high-pass filter 4 and then segmented into 22.5 ms frames comprising 180 samples taken at the 8 KHz frequency. Two linear prediction analyses are performed at the step 5 on each of the frames. On the steps 6 and 7, the semi-whitened signal obtained is filtered into four sub-bands. A robust pitch follower 8 exploits the first sub-band. The transition frequency $f_c$ between the low frequency band of the voiced sounds and the high frequency band of the unvoiced sounds is determined by the voicing rate measured at the step 9 in the four sub-bands. Finally, the energy is measured and encoded at the step 10 in a pitch-synchronous manner, four times per frame.

Since the performance characteristics of the pitch follower and the voicing analyzer 9 can be greatly improved when their decision is delayed by one frame, the resulting parameters, namely the coefficients of the synthesis filters, pitch, voicing, transition frequency and energy, are encoded with one lag frame.

In the synthesis part of the vocoder HSX which is shown in FIG. 3, the excitation signal of the synthesis filter is formed, as shown in FIG. 1, by the sum of a harmonic signal and a random signal whose spectral envelopes are complementary. The harmonic component is obtained by making a pulse train at the pitch period pass into a predesigned bandpass filter 11. The random component is obtained from a generator 12 combining a reverse Fourier transform and a time overlap operation. The synthesis LPC filter 14 is interpolated four times per frame. The perceptual filter 15 coupled at output of the filter 14 makes it possible to obtain the best restitution of the nasal characteristics of the original speech signal. Finally, with the automatic gain control device, it can be ensured that the pitch-synchronous energy of the output signal is equal to the energy that has been transmitted.

With a bit rate as low as 1200 bits per second, it is not possible to make a precise encoding, every 22.5 ms, of the four parameters, pitch, voice transmission frequency, energy and LPC filter coefficients with two coefficients per frame.

Figure 4:
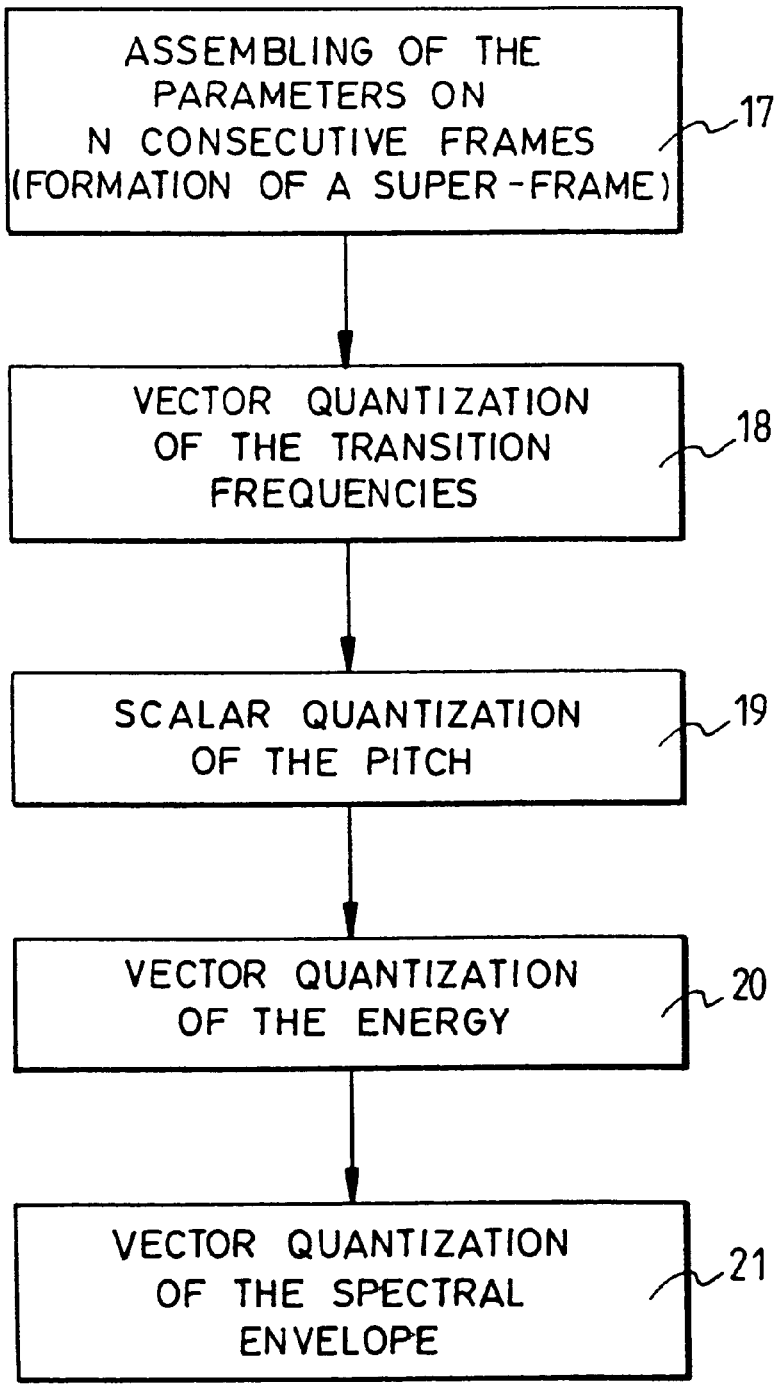
FIG. 4 shows the main steps of the method of the invention put in the form of a flow chart.

To make the most efficient use of the temporal characteristics of the development of the parameters which contain periods of stability interspersed with fast variations, the method according to the invention has five main steps referenced 17 to 21 in FIG. 4. The step 17 combines the vocoder frames in N frames in order to form a super-frame. For example, a value of N equal to 3 may be chosen because it provides a good compromise between the possible reduction of the binary bit rate and the delay introduced by the quantization method. Furthermore, it is compatible with present-day error corrective encoding and interlacing techniques.

The voicing transition frequency is encoded in the step 18 by vector quantization using only four frequency values, 0, 750, 2000 and 3625 Hz for example. In these conditions, 6 bits at 2 bits per frame are sufficient to encode each of the frequencies and transmit the voicing configuration of the three frames of a super-frame with precision. However, since some voicing configurations occur only very rarely, it may be assumed that they are not necessarily characteristic of the development of the normal speech signal because they do not seem to play a role in the intelligibility or quality of the restored speech. This is the case for example when a frame is totally voiced from 0 Hz to 3625 Hz and is contained between two totally unvoiced frames.

The table of FIG. 5 retraces a distribution of voicing configuration on three successive frames computed on a data base of 123,158 speech frames. In this table, the 32 least frequent configurations amount to only 4% of all the partially or totally voiced frames. The deterioration obtained by replacing each of these configurations by the closest, in terms of absolute value, of the 32 configurations most represented, is imperceptible. This shows that it is possible to save one bit by carrying out a vector quantization of voicing transmission frequency on a super-frame. A vector quantization of the voicing configurations is shown in a table referenced 22 in FIG. 6. The table 22 is organized so that the r.m.s. error produced by an error on an addressing bit is the minimum.

The pitch is encoded in the step 19. It implements a scalar quantizer on 6 bits with a zone of samples from 16 to 148 and a uniform quantization pitch on a logarithmic scale. A single value is transmitted for three consecutive frames. The computation of the value to be quantized from the three pitch values and the procedure used to recover the three pitch values from the quantized value differ according to the value of the voicing transition frequencies of the analysis. The process is as follows:

1. When no frame is voiced, the 6 bits are positioned at zero, the decoded pitch is fixed at an arbitrary value namely, for example, 45 samples for each of the frames of the super-frame.

2. When the last frame of the previous super-frame and the three frames of the current super-frame are voiced, namely when the voicing transition frequency is strictly greater than zero, the quantized value is the value of the pitch of the last frame of the current super-frame which is then considered to be a target value. At the decoder, the decoder value of the pitch of the third frame of the current super-frame is the quantized target value, and the values of the decoded pitch for the two first frames of the current super-frame are recovered by linear interpolation between the value transmitted for the previous super-frame and the quantized target value.
3. For all the other voicing configurations, it is the weighted value of the pitch on the three frames of the current super-frame that is quantized. The weighting factor is proportional to the voicing transition frequency for the frame considered according to the relationship:

$$\text{Mean weight value} = \frac{\sum_{i=1-3} Pitch(i) * voicing(i)}{\sum_{i=1-3} voicing(i)}$$

At the decoder, the value of the decoded pitch for the three frames of the current super-frame is equal to the quantized weighted mean value.

Furthermore, in the cases 2 and 3, a light tremolo is applied methodically to the values of the pitch used in synthesis for the frames 1, 2 and 3 to improve the natural aspect of the stored speech while preventing the generation of excessively periodic signals, for example according to the relationships:

Pitch used (1)=0.995* decoded pitch (1)

Pitch used (2)=1.005* decoded pitch (2)

Pitch used (3)=1.000* decoded pitch (3)

The utility of carrying out a scalar quantization of pitch values is that it is restricts the problem of propagation of the errors on the binary string. Furthermore, the encoding patterns 2 and 3 are sufficiently close to each other to be insensitive to wrong decodings of the voicing frequency.

The encoding of the energy is done at the step 20. It is done, as shown in the table referenced 23 in FIG. 7, by using a method of vector quantization of the type described in the article by R. M. Gray, "Vector Quantization", IEEE Journal. ASP Magazine, Vol. 1, pp. 4–29, April 1984. Twelve energy values numbered 0 to 11 are computed at each super-frame by the analyzed part and only six energy values among the twelve are transmitted. This leads to the construction of two vectors of three values by the analyzed part. Each vector is quantized on six bits. Two bits are used to transmit the selection pattern number used. During the decoding in the synthesis part, the energy values that are not quantized are recovered by interpolation.

Only four selection patterns are authorized as can be seen in the table of FIG. 7. These patterns are optimized for the most efficient encoding either of the vectors of 12 stable energy values or those for which the energy varies rapidly during the frames 1, 2 and 3. In the analyzed part, the energy vector is encoded according to each of the four patterns and the pattern that is actually transmitted is the one that minimizes the total squared error.

In this process, the bits giving the number of the transmitted diagram are not considered to be sensitive since an error in their value only slightly alters the temporal progress of the value of the energy. Furthermore, the table of vector quantization of the energy values is organized so that the root mean square error produced by an error on an addressing bit is the minimum.

The encoding of the coefficients modelling the envelope of the speech signal takes place by vector quantization at the step 21. This encoding makes it possible to determine the coefficients of the digital filters used in the synthesis part. Six LPC filters with 10 coefficients numbered 0 to 5 are computed at each super-frame on the analyzed part and only three of the six filters are transmitted. The six vectors are converted into six vectors of 10 pairs of LSF spectral lines following for example the process described in the article by F. Itakura, "Line Spectrum Representation of Linear Predictive Coefficients" in the Journal of the Acoustique Society of America, vol.57, P.S35, 1975. The pairs of spectral lines are encoded by a technique similar to the one implemented for the energy encoding. The process consists of the selection of three LPC filters and the quantizing of each of these vectors on 18 bits by using for example an open-loop predictive vector quantizer with a predictive coefficient equal to 0.6 of the SPLIT-VQ type relating to two sub-packets of 5 consecutive LSF filters to each of which 9 bits are allocated. Two bits are used to transmit the number of the selection pattern used. At the level of the decoder, when an LPC filter is not quantized, its value is estimated from that of the LPC filters quantized by linear interpolation for example, or by extrapolation by duplication for example of the previous filter LPC. For example, a method of vector quantization by packets could be constituted as described in the article by K. K. PALIWAL, B. S. ATAL, "Efficient Vector Quantization of LPC Parameters at 24 bits/frame" in IEEE Transactions on Speech and Audio Processing, Vol.1, January 1993.

As shown in the table referenced 24 in FIG. 8, only four selection patterns are authorized. These patterns enable the most efficient encoding either of the zones for which the spectral envelope is stable or of the zones for which the spectral envelope varies rapidly during the frames 1, 2 and 3. All the LPC filters are then encoded according to each of the four patterns and the pattern that is actually transmitted is the one that minimizes the total squared error.

As in the encoding of the energy, the bits giving the nature of the pattern should not be considered to be sensitive since an error in their value only slightly changes the temporal evolution of the LPC filters. Furthermore, the vector quantization tables of the LSF filters are organized in the synthesis part so that the root mean square error produced by an error on an addressing bit is the minimum.

The bit allocation for the transmission of the LSF, energy, pitch and voicing parameters that results from the encoding method implemented by the invention is shown in the table of FIG. 9 in the context of a 1200 bits/s vocoder in which the parameters are encoded every 67.5 ms, 81 bits being available at each super-frame to encode the parameters of the signal. These 81 bits can be subdivided into 54 LSF bits, 2 bits for the decimation of the pattern of the LSF filters, twice 6 bits for the energy, 6 bits for the pitch and 5 bits for the voicing.

What is claimed is:

1. Method of encoding and decoding speech for voice communications using a vocoder with very low bit rate comprising an analysis part for the encoding and transmission of the parameters of the speech signal and a synthesis part for the reception and decoding of the transmitted parameters, and the rebuilding of the speech signal through the use of linear predictive synthesis filters of the type analyzing the parameters, describing the pitch, the voicing transition frequency, the energy, and the spectral envelope of the speech signal, by subdividing the speech signal into successive frames of given length, the method comprising assembling the parameters on N consecutive frames to form a super-frame, making a vector quantization of the transition frequencies of the voicing during each super-frame, transmitting without deterioration only the most frequent configurations and replacing the least frequent configurations by the configuration that is the nearest in terms of absolute error among the most frequent configurations, encoding the pitch in carrying out a scalar quantization of only one value of the pitch for each super-frame, encoding the energy in selecting only a reduced number of values in assembling these values in sub-packets quantized by vector quantization, the non-transmitted energy values being recovered in the synthesis part by interpolation or extrapolation from transmitted values, encoding, by vector quantization, the spectral envelope parameters for the encoding of the linear predictive synthesis filters in selecting only a determined number of filters, the untransmitted parameters being rebuilt by interpolation or extrapolation from the parameters of the transmitted filters.

2. Method according to claim 1, wherein the quantized value of the pitch is either the last value of the pitch of the entirely voiced stable zones or a mean value weighted by the voicing transition frequency in the zones that are not entirely voiced.

3. Method according to claim 2, wherein when the pitch value is the last value of a super-frame, the other values are reconstituted by interpolation.

4. Method according to claim 3, wherein the value of the pitch used in the synthesis part is that of the decoded pitch modified by a multiplication coefficient to produce a light tremolo in the reconstituted speech.

5. Method according to claim 1, wherein the parameters are assembled on a number N=3 of consecutive frames.

6. Method according to claim 5, wherein the voicing frequencies are 4 in number and are encoded vectorially by means of a quantization table comprising 32 configurations of frequencies grouped in sets of 3.

7. Method according to claim 5, further comprising measuring the energy four times per frame, and only 6 values among the 12 values of a super-frame are transmitted in the form of two vectors of 3 values.

8. Method according to claim 7, further comprising encoding the energy according to four patterns, each assembling two vectors, a first vector, a first pattern when the twelve energy vectors in the super-frame are stable, the remaining patterns being defined for each of the frames, and in transmitting the pattern that minimizes the total squared error.

9. Method according to claim 8, wherein:

in the first pattern, only the energy values numbered 1, 3, and 5 of the first vector and those numbered 7, 9, 11 of the second vector are transmitted, in the second pattern, only the energy values numbered 0, 1, and 2 of the first vector and the values numbered 3, 7, and 11 of the second vector are transmitted, in the third pattern, only the energy values numbered 1, 4, 5 of the first vector and those numbered 6, 7, and 11 of the second vector are transmitted, and in the fourth pattern, only the energy values numbered 2, 5 and 8 of the first vector and those numbered 9, 10 and 11 of the second vector are transmitted.

10. Method according to claim 1, further comprising selecting the encoding parameters of the linear predictive filters according to four patterns to achieve the most efficient encoding for which the spectral envelope is stable, namely the zones for which the spectral envelope varies rapidly during the frames 1, 2, or 3 of a super-frame.

11. Method according to claim 10, further comprising using, in the synthesis part, 6 linear predictive filters with 10 coefficients numbered 0 to 5 and to be transmitted.

in a first pattern, only the coefficients of the filters 1, 3, and 5 when the spectral envelope is stable, in a second pattern corresponding to the first frame, only the coefficients of the filters 0, 1 and 4, in a third pattern corresponding to the second frame, only the coefficients of the filters 2, 3 and 5, in a fourth pattern corresponding to the third frame, only the coefficients of the filters 1, 4 and 5, the pattern effectively transmitted being the one that minimises the total squared error, the coefficients of the non-transmitted filters being computed in the synthesis part by interpolation or extrapolation.

12. Method according to claim 1, wherein the LSF coefficients of the synthesis filters are encoded on a number of 54 bits to which there are added two bits for the transmission of the decimation patterns, the energy is encoded with a number equal to two times 6 bits to which to which 2 bits are added for the transmission of the decimation patterns, the pitch is encoded on a number equal to 6 bits and the voicing transition frequency is encoded on a number equal to 5 bits giving a total of 81 bits for the 67.5 ms super-frames.

* * * * *